US009932937B2

(12) United States Patent
Jentz et al.

(10) Patent No.: US 9,932,937 B2
(45) Date of Patent: Apr. 3, 2018

(54) FUEL SYSTEM DIAGNOSTICS

(71) Applicant: Ford Global Technologies, LLC, Dearborn, MI (US)

(72) Inventors: Robert Roy Jentz, Westland, MI (US); Mark W. Peters, Wolverine Lake, MI (US); Scott A. Bohr, Plymouth, MI (US); Russell Randall Pearce, Ann Arbor, MI (US); Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 703 days.

(21) Appl. No.: 13/677,544

(22) Filed: Nov. 15, 2012

(65) Prior Publication Data

US 2014/0130781 A1 May 15, 2014

(51) Int. Cl.
*F02M 25/08* (2006.01)

(52) U.S. Cl.
CPC .... *F02M 25/0809* (2013.01); *F02M 25/0818* (2013.01); *F02M 25/0827* (2013.01); *F02M 25/0836* (2013.01)

(58) Field of Classification Search
CPC ..... F02M 25/0809; F02M 25/0818; F02M 25/0827; F02M 25/0836
USPC ..... 123/519–521; 73/114.39, 114.77
See application file for complete search history.

(56) References Cited

U.S. PATENT DOCUMENTS 5,295,472 A * 3/1994 Otsuka et al. ..... 123/520
5,592,923 A * 1/1997 Machida ..... 123/520
5,614,665 A * 3/1997 Curran et al. ..... 73/114.39
5,979,160 A * 11/1999 Yashiki et al. ..... 60/276
6,467,463 B2 * 10/2002 Kitamura ..... F02M 25/0809 123/516
6,626,032 B2 * 9/2003 Fabre et al. ..... 73/114.39
6,631,635 B2 * 10/2003 Hanazaki et al. ..... 73/114.39
6,837,224 B2 * 1/2005 Kidokoro ..... F02M 25/0809 123/520
6,968,732 B2 11/2005 Nakoji
7,506,639 B2 3/2009 Saito
8,016,525 B2 * 9/2011 Comeau ..... 410/49
(Continued)

FOREIGN PATENT DOCUMENTS

CN 102312756 A 1/2012

OTHER PUBLICATIONS

Anonymous, "Perform the OBD Fuel System Leak Test upon Initial Engine Cold Start," IPCOM No. 000240879, Published Mar. 9, 2015, 2 pages.

(Continued)

*Primary Examiner* — Erick Solis
*Assistant Examiner* — Robert Werner
(74) *Attorney, Agent, or Firm* — Julia Voutyras; McCoy Russell LLP

(57) ABSTRACT

Methods and system are provided for distinguishing fuel tank vacuum generation due to canister purge valve degradation from vacuum generation due to canister vent valve degradation. A fuel tank vacuum level is monitored after sealing the fuel tank from the atmosphere following an engine pull-down. If there is an ensuing change in fuel tank vacuum, canister purge valve degradation is determined, else, canister vent valve degradation is determined.

15 Claims, 3 Drawing Sheets

(56) References Cited

U.S. PATENT DOCUMENTS

2012/0152210 A1* 6/2012 Reddy et al. ..... 123/520

OTHER PUBLICATIONS

Partial Translation of Office Action of Chinese Patent Application No. 201310559940.X, dated Feb. 23, 2017, State Intellectual Property Office of PRC, 8 pages.

* cited by examiner

FUEL SYSTEM DIAGNOSTICS

FIELD

The present description relates to systems and methods for improving detection of fuel system degradation in a vehicle, such as a hybrid vehicle.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel.

Diagnostic routines may be intermittently performed to verify functionality of emission control system components, such as various valves coupled to the canister. One example approach is shown by Machida et al. in U.S. Pat. No. 5,592,923. Therein, an engine intake manifold vacuum is applied on the emission control system. A reference pressure is determined based on a combination of open and close conditions of emission control system valves. Based on a difference between an estimated system pressure relative to the reference pressure, degradation of a canister purge valve (coupled between the canister and the intake manifold) may be determined. Another example approach is shown by Otsuka et al. in U.S. Pat. No. 5,295,472. Therein, an engine control system identifies degradation of a canister vent valve (coupled between the canister and the atmosphere) and degradation of the canister purge valve based on a rate of change in fuel tank pressure following application of intake manifold vacuum on the fuel tank.

However, the inventors herein have identified potential issues with such an approach. As one example, the approach of Otsuka and Machida may not accurately distinguish elevated fuel tank vacuum levels caused by a stuck closed canister vent valve from elevated vacuum caused by a leaky open canister purge valve. In addition, since the diagnostic routine is performed while the engine is running, engine vacuum noise may corrupt degradation detection results. As such, if the canister vent valve or purge valve degradation is not accurately identified, fuel tank vacuum levels may become excessive, potentially harming the fuel tank. Further, if canister vent valve and purge valve degradation are not accurately distinguished, appropriate mitigating steps may not be possible. As such, this may lead to an increase in MIL warranty.

In one example, some of the above issues may be addressed by a method for a vehicle fuel system, comprising: sealing a fuel system (from atmosphere and an engine intake) after an engine pull-down; and distinguishing degradation of a canister vent valve from degradation of a canister purge valve based on a change in fuel system vacuum following the sealing.

As an example, during engine running conditions, a fuel tank (negative) pressure may be monitored. In response to excessive fuel tank vacuum levels (e.g., fuel tank vacuum being higher than a threshold level), degradation of one of the fuel system canister purge valve and the fuel system canister vent valve may be determined. To distinguish between the two and enable appropriate mitigating steps to be taken, the fuel tank may be isolated following a subsequent engine pull-down. As such, the engine pull-down may include a vehicle key-off condition (wherein the vehicle operator has explicitly indicated a desired to shut down the engine) or may include shift of vehicle operation (in a hybrid vehicle) from an engine mode to an electric mode. Further still, an engine pull-down may occur during an idle-stop in vehicles where the engine can be selectively deactivated during idle-stop conditions. As such, following an engine pull-down, engine vacuum noise may be reduced, and fuel system valve degradation may be identified more accurately.

In particular, after the engine pull-down, a vehicle controller may isolate the fuel tank by closing the canister vent valve (to isolate the fuel tank from the atmosphere) while also closing the canister purge valve (to isolate the fuel tank from the engine intake), or while maintaining the canister purge valve closed. If the fuel tank vacuum level falls (e.g., below the threshold level) following the sealing of the fuel tank, it may be determined that the previously experienced excessive fuel tank vacuum was due to the canister purge valve being stuck open. However, if the fuel tank vacuum level remains elevated, the controller may try to actuate the vent valve open while maintaining the purge valve closed. If there is still no change in fuel tank vacuum following the actuation of the vent valve, it may be determined that the canister vent valve (e.g., the canister vent solenoid) is stuck closed. If the fuel tank vacuum gradually bleeds up (to atmospheric conditions) following the actuation of the vent valve, it may be determined that the fuel system valves are not degraded and that the elevated fuel tank vacuum may be due to a blockage in a fresh air line (that is, the canister vent).

In this way, by correlating changes in vacuum level of an isolated fuel tank with the commanded position of various fuel system valves, canister vent valve degradation and canister purge valve degradation can be identified and differentiated. By performing the diagnostics during conditions when the engine is not running, errors in degradation detection incurred due to engine vacuum noise contributions can be reduced. By improving the accuracy of degradation detection and differentiation, appropriate mitigating steps can be taken to reduce the unintended elevation of fuel tank vacuum levels. Overall, fuel system integrity can be better maintained.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

Figure 1:
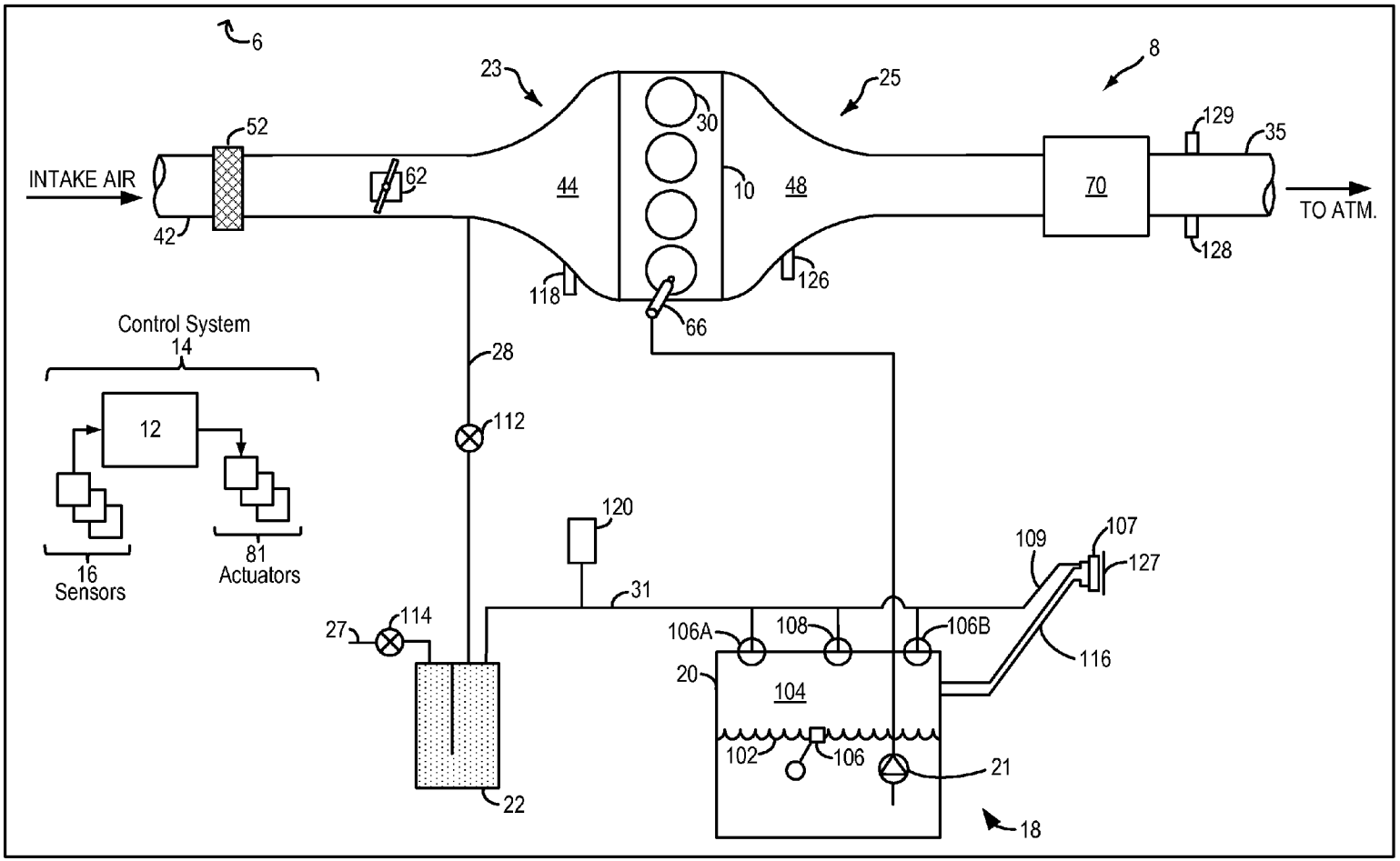
FIG. 1 shows a schematic depiction of a vehicle fuel system.

Methods and systems are provided for identifying degradation in a fuel system coupled to a vehicle engine, such as the fuel system of FIG. 1. A diagnostic routine may be performed in response to the detection of elevated fuel tank vacuum levels. A controller may be configured to perform a control routine, such as the example routine of FIG. 2, to seal the fuel tank following an engine pull-down if elevated fuel tank vacuum is detected. The controller then identifies and distinguishes canister vent valve degradation from canister purge valve degradation based on changes in the fuel tank vacuum following the sealing. An example diagnostic test is shown at FIG. 3. In this way, accuracy of fuel system degradation detection is improved.

FIG. 1 shows a schematic depiction of a hybrid vehicle system 6 that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. Fuel tank 20 receives fuel via a refueling line 116, which acts as a passageway between the fuel tank 20 and a refueling door 127 on an outer body of the vehicle. During a fuel tank refueling event, fuel may be pumped into the vehicle from an external source through refueling inlet 107. During a refueling event, one or more fuel tank vent valves 106A, 106B, 108 (described below in further details) may be open to allow refueling vapors to be directed to, and stored in, canister 22.

Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

Vapors generated in fuel tank 20 may be routed to fuel vapor canister 22, via conduit 31, before being purged to the engine intake 23. Fuel tank 20 may include one or more vent valves for venting diurnals and refueling vapors generated in the fuel tank to fuel vapor canister 22. The one or more vent valves may be electronically or mechanically actuated valve and may include active vent valves (that is, valves with moving parts that are actuated open or close by a controller) or passive valves (that is, valves with no moving parts that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. However, during vehicle operation on an incline, when a fuel level 102 on at least one side of the fuel tank is artificially raised, vent valve 106A, 106B may close to prevent liquid fuel from entering vapor line 31. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system. Also, the wiring required to couple such electronic vent valves to the controller may act as a potential ignition source inside the fuel tank, increasing fire hazards in the fuel system.

Returning to FIG. 1, fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 via purge line 28 by opening canister purge valve 112. While a single canister 22 is shown, it will be appreciated that fuel system 18 may include any number of canisters.

Canister 22 includes a vent 27 (herein also referred to as a fresh air line) for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used.

Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. By closing canister vent valve 114, the fuel tank may be isolated from the atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, in some embodiments, a fuel tank isolation valve (not shown) may be optionally included in conduit 31 such that fuel tank 20 is coupled to canister 22 via the isolation valve. When included, the isolation valve may be kept closed during engine operation so as to limit the amount of diurnal vapors directed to canister 22 from fuel tank 20. During refueling operations, and selected purging conditions, the isolation valve may be temporarily opened to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled between the fuel tank and canister 22, in alternate embodiments, the pressure sensor may be directly coupled to fuel tank 20.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. As such, during the canister purging, the fuel tank vent valves 106A, 106B, and 108 are assumed to be open (though in some embodiments, some combination of valves may be closed). During this mode, vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Controller 12 may also be configured to intermittently perform leak detection routines on fuel system 18 to confirm that the fuel system is not degraded. As such, leak detection routines may be performed while the vehicle is running with the engine on (e.g., during an engine mode of hybrid vehicle operation) or with the engine off (e.g., during a battery mode of hybrid vehicle operation). Leak tests performed while the engine is off may include applying an engine-off natural vacuum on the fuel system. Therein, the fuel tank may be sealed when the engine is turned off by closing the canister purge valve and canister vent valve. As the fuel tank cools down, vacuum is generated in the vapor space of the fuel tank (due to the relation between temperature and pressure of gases). During natural vacuum leak detection, the canister vent valve (CVV) is closed and a pressure build or vacuum build is monitored to ascertain leak integrity. If the fuel tank pressure stabilizes faster than expected, a fuel system leak is determined. Leak tests performed while the engine is on may include applying an engine intake vacuum on the fuel system for a duration (e.g., until a target fuel tank vacuum is reached) and then sealing the fuel system while monitoring a change in fuel tank pressure (e.g., a rate of decay in the vacuum level, or a final pressure value). A fuel system leak may then be identified based on a rate of vacuum bleed-up to atmospheric pressure.

As such, if any of the canister purge valve or canister vent valve is stuck, excessive vacuum can result in the fuel tank. This can harm and damage the fuel tank if not addressed. The excessive vacuum can result either from a canister vent valve that is stuck closed or from a canister purge valve that is stuck open (or leaky open). As such, based on whether the excessive vacuum is due to degradation of the canister purge valve or the canister vent valve, the mitigating action may vary. Therefore, the inventors herein have recognized that it may be important to distinguish whether excessive fuel tank vacuum is due to a canister purge valve being stuck open or a canister vent valve being stuck closed. As elaborated herein with reference to FIG. 2, in response to excessive fuel tank vacuum observed during engine running, an engine controller may distinguish between the valve issues based on change in a fuel tank vacuum, following isolation of the fuel tank, after an engine pull-down. In particular, based on whether the excessive fuel tank vacuum persists in the sealed fuel tank after the engine pull-down, or whether the fuel tank vacuum starts to bleed-up, it may be determined if the canister purge valve or the vent valve is degraded. By monitoring the fuel tank vacuum after an engine pull-down, an engine vacuum noise factor is reduced, improving the controller's ability to accurately pinpoint the root cause of the excessive vacuum. By improving the accuracy of valve degradation detection, fuel tank damage due to excessive tank vacuums can be reduced.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, and pressure sensor 129. Other sensors such as additional pressure, temperature, air/fuel ratio, and composition sensors may be coupled to various locations in the vehicle system 6. As another example, the actuators may include fuel injector 66, canister purge valve 112, canister vent valve 114, and throttle 62. The control system 14 may include a controller 12. The controller may receive input data from the various sensors, process the input data, and trigger the actuators in response to the processed input data based on instruction or code programmed therein corresponding to one or more routines. An example control routine is described herein with regard to FIG. 2.

In this way, the system of FIG. 1 enables a method for a vehicle fuel system wherein a fuel system is sealed from the atmosphere after an engine pull-down. The sealing is performed in response to an indication of excessive fuel tank vacuum received while the engine is running. The method further enables degradation of a canister vent valve to be distinguished from degradation of a canister purge valve based on a change in fuel system vacuum following the sealing.

Figure 2:
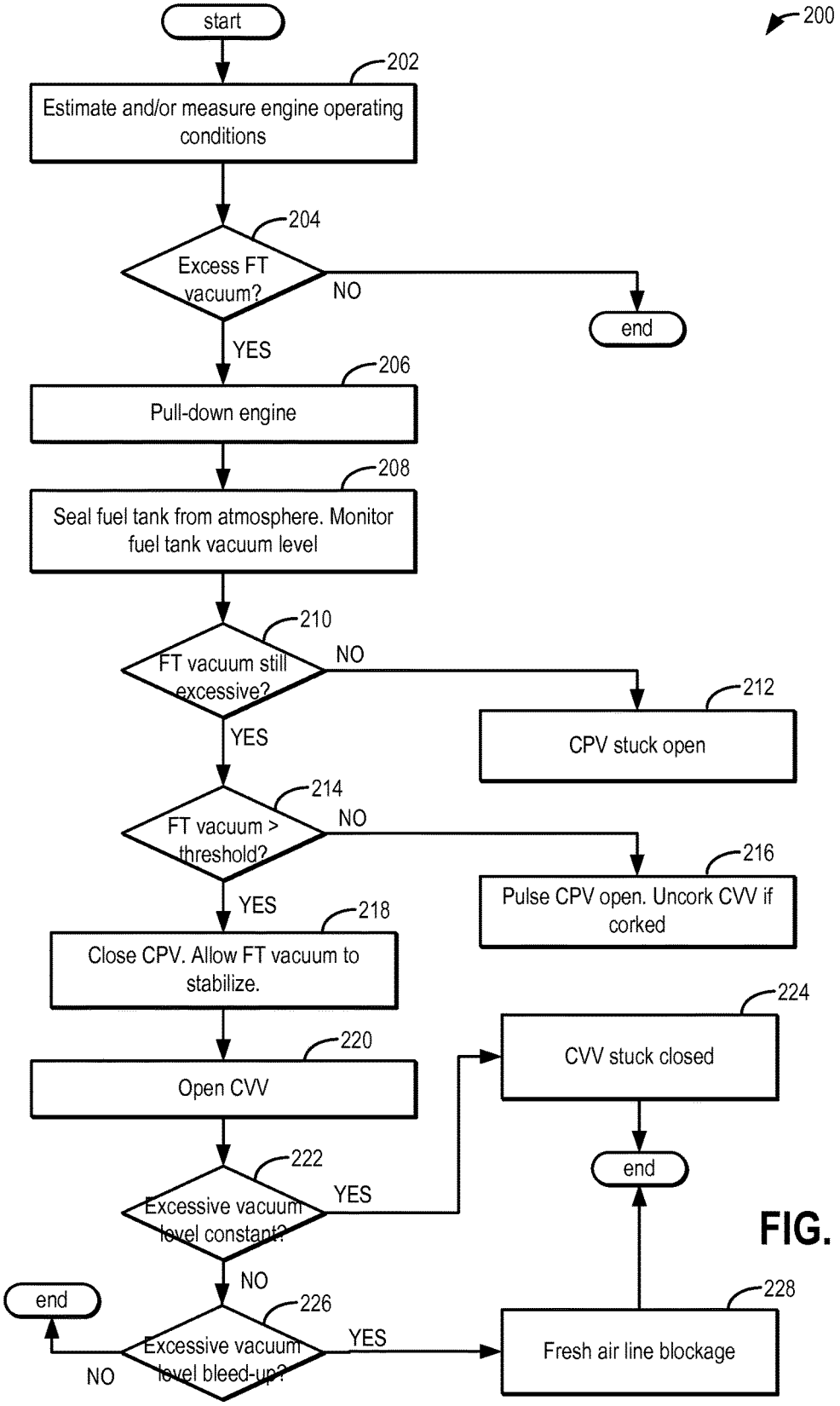
FIG. 2 shows a high level flow chart illustrating a routine that may be implemented for identifying and differentiating fuel system degradation due to canister purge valve degradation from canister vent valve degradation.
Figure 3:
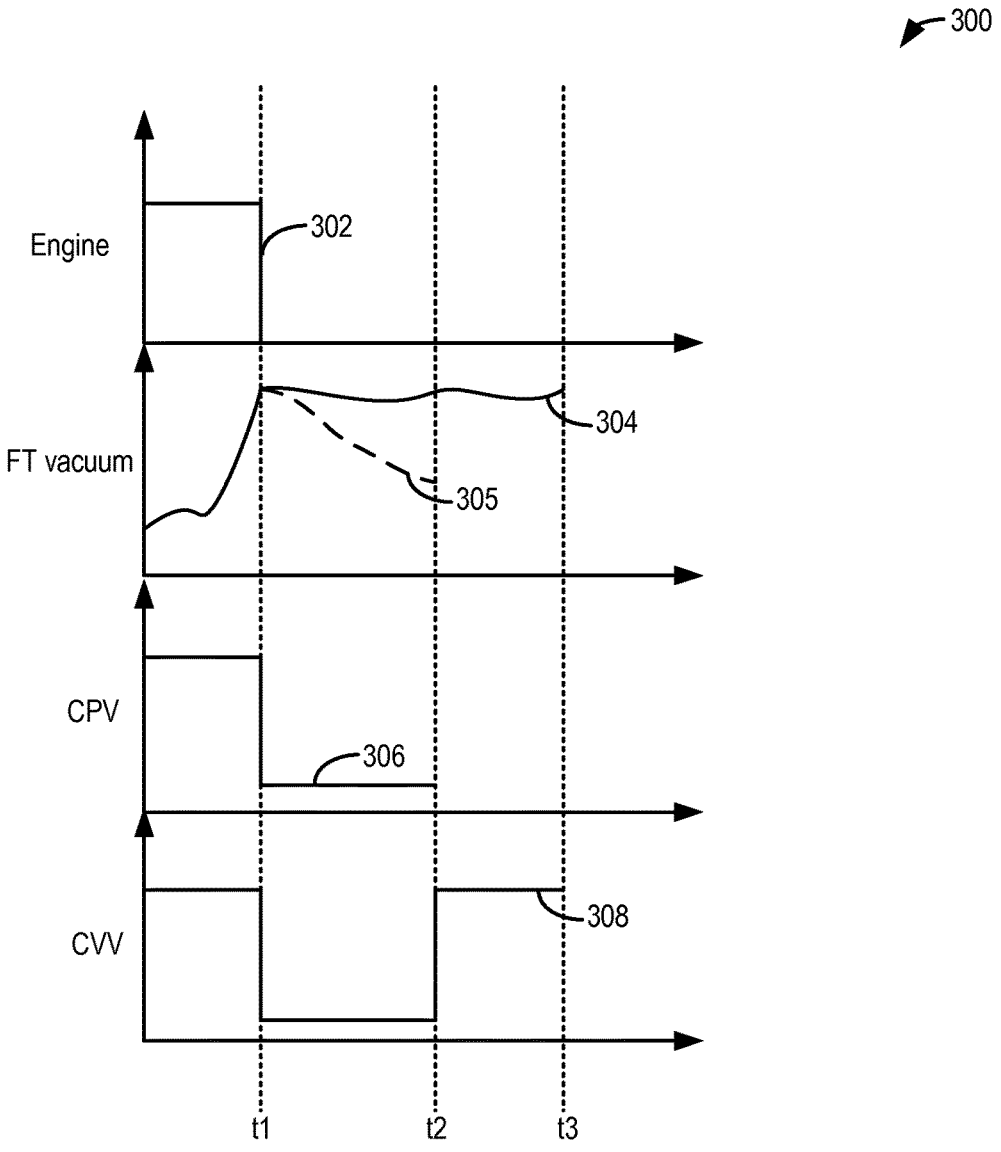
FIG. 3 shows an example fuel system diagnostic test, according to the present disclosure.

Now turning to FIG. 2, an example routine 200 is shown for identifying a cause of excessive fuel tank vacuum. In particular, it may be determined whether fuel tank vacuum levels are elevated due to a canister purge valve being stuck open or a canister vent valve being stuck closed. Based on the determination, appropriate mitigating steps may be taken.

At 202, engine operating conditions may be estimated and/or measured. These may include, for example, engine speed, ambient conditions, engine temperature, fuel level, fuel tank pressure and temperature, fuel system vacuum level, etc. At 204, it may determined if a fuel system vacuum level is higher than a threshold level of vacuum (for example, higher than 16 InH2O). In one example, the fuel system vacuum level includes a fuel tank vacuum level. Thus at 204, it may be determined if there is excessive fuel tank vacuum. If not, the routine may end and it may be determined that there is no degradation of fuel system valves.

If excessive fuel system vacuum is detected (for example, if excessive fuel tank vacuum is detected at a key-on event), then at 206, the engine may be pulled-down. An engine pull-down may include, for example, a vehicle key-off condition (wherein the vehicle operator keys off engine operation), a vehicle key-on engine idle-stop (wherein the engine is selectively deactivated in response to idle-stop conditions), and/or a vehicle key-on electric mode of operation (wherein vehicle operation is shifted from engine mode to battery mode). In one example, wherein the engine pull-down occurs during a vehicle key-off condition, an engine controller may be maintained awake during the engine pull-down and while the engine is not running.

At 208, after an engine pull-down has been confirmed, the fuel system may be sealed from the atmosphere and the engine intake. Herein, sealing the fuel system from the atmosphere includes closing a canister vent valve coupled between a fuel system canister and the atmosphere. For example, a controller may actuate a canister vent valve solenoid closed. Further, sealing the fuel system from the engine intake includes closing a canister purge valve coupled between the fuel system canister and the engine intake. For example, the controller may actuate a canister purge valve solenoid closed. A fuel tank vacuum level may then be monitored after sealing the fuel system.

At 210, it may be determined if there is a change in the fuel tank vacuum level following the sealing of the fuel system. In particular, it may be determined if the fuel tank vacuum level is still higher than the threshold (as it was before the sealing, at 204). If not (that is, if there is a substantial change in fuel tank vacuum), then at 212, in response to fuel system vacuum being higher than the threshold before the sealing and being lower than the threshold after the sealing, the routine indicates canister purge valve degradation and does not indicate canister vent valve degradation. In particular, it may be indicated that the canister purge valve is stuck open. Thus, it may be indicated that the excessive fuel system vacuum observed during engine running was due to degradation of the canister purge valve (and not due to degradation of the canister vent valve). In some embodiments, in response to the canister purge valve being determined to be stuck open, the controller may set a diagnostic code (e.g., an MIL). Further, the controller may terminate leak detection where the CVV is commanded to close. This protects the fuel tank.

In comparison, in response to the fuel system vacuum level being higher than the threshold before the sealing as well as after the sealing (that is, if there is substantially no change following the sealing), the routine includes, at 214, determining if the fuel system vacuum is still higher than the threshold after. For example, it may determine if the fuel system vacuum level is higher than 16InH2O. The threshold may be based on limitations of the pressure sensor. Further, the threshold may vary based on the nature of the fuel tank. For example, steel fuel tanks may enable use of higher thresholds than plastic fuel tanks.

If not, then at 216, the canister purge valve may be pulsed open (since it is a duty cycled device). This allows a corked canister vent valve to be uncorked.

If, at 214, the fuel system vacuum is still higher than the threshold vacuum level after the actuating open of the canister vent valve, then at 218 the controller may actuate the canister purge valve closed. Alternatively, if the canister purge valve is already actuated closed, the controller may maintain the canister purge valve closed and wait for the fuel tank vacuum level to stabilize. Subsequently, after the fuel tank vacuum has stabilized, at 220, the routine includes commanding the canister vent valve open. For example, the controller may command the vent valve solenoid open.

After commanding the canister vent valve open, at 222, the routine includes reassessing the fuel system vacuum level to see if it is still excessive and further if it is holding constant. For example, it may be determined if the fuel tank vacuum level is still higher than the threshold level and if a rate of change in the fuel tank vacuum level is smaller than a threshold rate (e.g., negligible). If yes, then at 224, the routine includes indicating canister vent valve degradation in response to the fuel system vacuum remaining higher than the threshold after the actuating of the canister vent valve solenoid and does not indicate canister purge valve degradation. In particular, it may be indicated that the canister vent valve (or solenoid) is stuck closed. Thus, it may be indicated that the excessive fuel system vacuum observed during engine running was due to degradation of the canister vent valve (and not due to degradation of the canister purge valve). In some embodiments, in response to the canister vent valve being determined to be stuck closed, the controller may set a diagnostic code (e.g., an MIL). Further, the controller may disable purging or limit purging to a small duty cycle. This protects the fuel tank.

If at 222, the fuel system vacuum level is not constant, then at 226, it may be determined if the excessive fuel tank vacuum is slowly bleeding up. For example, it may be determined if the fuel tank vacuum is gradually moving towards atmospheric pressure levels. If not, the routine may end. Else, at 228, in response to bleed-up of the fuel system vacuum from the threshold level after the actuating of the canister vent valve, the routine includes indicating blockage in a fresh air line. That is, it may be indicated that the excessive fuel system vacuum observed during engine running was due to a blockage in a canister fresh air line (and not due to degradation of either the canister vent valve or the canister purge valve). In some embodiments, in response to the fresh air line (that is, the canister vent line) being blocked, the controller may set a diagnostic code (e.g., an MIL) and disable or limit purging.

In this way, the method of FIG. 2 enables degradation of a canister vent valve to be distinguished from degradation of a canister purge valve based on a change in fuel system vacuum following sealing of the fuel tank, after an engine pull-down. In particular, by performing the diagnostic routine when an engine vacuum noise factor is substantially lower, accuracy of degradation detection is improved. Consequently, a fuel system valve issue may be identified earlier and addressed in a timely fashion.

In one example, a fuel tank may be sealed from the atmosphere after an engine pull-down. Then, during a first condition, canister purge valve degradation may be indicated based on a change in fuel tank vacuum following the sealing. In comparison, during a second condition, canister vent valve degradation may be indicated based on the change in fuel tank vacuum following the sealing. As such, the sealing of the fuel tank may be performed in response to a fuel tank vacuum being higher than a threshold level (e.g., excessive, or above 16InH2O) during engine running. Further, the sealing may be performed after an engine pull-down to reduce corruption of the results by the engine vacuum noise. A canister vent valve may be actuated closed while a canister purge valve is maintained closed to seal the fuel tank from the atmosphere. In the example, during the first condition, the indicating includes indicating that the canister purge valve is stuck open in response to the fuel tank vacuum being lower than the threshold following the sealing. In comparison, during the second condition, the indicating includes indicating that the canister vent valve is stuck closed in response to the fuel tank vacuum remaining higher than the threshold after the sealing, and also remaining higher than the threshold upon actuating the canister vent valve open.

Further, during a third condition, in response to fuel tank vacuum remaining higher than the threshold after the sealing, and bleeding up to atmospheric conditions upon actuating the canister vent valve, no degradation of either the canister vent valve or the canister purge valve may be indicated. Rather, it may be indicated that the excessive fuel system vacuum observed during engine running was due to a blockage in a canister fresh air line (that is, canister vent).

Now turning to FIG. 3, map 300 depicts example changes in fuel tank vacuum that may be used to identify and differentiate canister purge valve degradation from canister vent valve degradation. In particular, map 300 depicts engine operation at plot 302, changes in a fuel tank (FT) vacuum level are shown at plot 304, canister purge valve (CPV) operation is shown at plot 306, and canister vent valve (CVV) operation is shown at plot 308.

Prior to t1, a vehicle may be operating with the engine running. While the engine is running, the canister vent valve and the canister purge valve may be opened (plots 306, 308) so as to purge a fuel system canister. Just prior to t1, a sudden increase in fuel tank vacuum may be seen (plot 304). As such, the excessive fuel tank vacuum may cause fuel tank damage. Thus, at t1, in response to the elevated fuel tank vacuum, an engine pull-down may be performed. In particular, the engine may be shut down so that a diagnostic routine can be performed to identify the cause of the elevated vacuum. As such, the elevated fuel tank vacuum may be due to canister purge valve degradation or canister vent valve degradation. By performing the diagnostic routine after the engine has been pulled down, an engine vacuum noise factor can be reduced, improving the accuracy of the diagnosis.

After pulling down the engine, at t1, the canister purge valve and the canister vent valve may be commanded closed. By closing the canister vent valve, the fuel tank may be sealed from the atmosphere. A fuel tank vacuum level may then be monitored following the sealing of the fuel tank. In one example, as shown at plot 305 (dashed line), following the sealing of the fuel tank, a fuel tank vacuum may start to decrease from the elevated level (e.g., from above a threshold to below a threshold). In response to the fuel tank vacuum level being higher than a threshold before the sealing of the fuel tank, but being lower than the threshold after the sealing, at t2, it may be determined that there was a canister purge valve degradation that caused the elevated fuel tank vacuum prior to t1. Accordingly, at t2, a diagnostic code may be set to indicate that the canister purge valve was stuck open.

If the fuel tank vacuum does not substantially change following the sealing of the fuel tank (that is, the vacuum level remains elevated and above a threshold, as shown at plot 304), then it may be determined that the elevated vacuum was not due to canister purge valve degradation. Next, at t2, the canister vent valve (plot 308) may be actuated open and the fuel tank vacuum may be monitored again. If the fuel tank vacuum level continues to remain elevated following the actuating of the canister vent valve, then at t3, it may be determined that there was a canister vent valve degradation that caused the elevated fuel tank vacuum prior to t1. Accordingly, at t3, a diagnostic code may be set to indicate that the canister vent valve was stuck closed.

In some embodiments (not shown), the fuel tank vacuum level may start to gradually decrease (from the elevated vacuum level towards atmospheric pressure levels) following the actuating of the canister vent valve. If this happens, then it may be determined that there was neither canister vent valve degradation nor canister vent valve degradation. Rather, it may be determined that the elevated fuel tank vacuum observed prior to t1 was caused due to a blockage in the canister vent (or fresh air line).

It will be appreciated that in embodiments where the engine is configured in a hybrid vehicle system, an isolation valve coupled between the fuel tank and the fuel system canister may remain open (not shown in FIG. 3) during the diagnosis routine.

In this way, a root cause of excessive fuel tank vacuum levels observed during engine running may be better identified. In particular, by isolating the fuel tank and monitoring changes in fuel tank vacuum of the isolated fuel tank when the engine has been pulled-down, even smaller changes in fuel tank vacuum can be used to better distinguish canister purge valve degradation from canister vent valve degradation. In particular, by performing the diagnostics during conditions when the engine is not running, engine vacuum noise contributions can be reduced, and an accuracy of degradation detection and differentiation is improved. Further, by improving the reliability of degradation determination, the efficiency of degradation mitigation is improved. Overall, fuel system integrity is enabled.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A method for an engine, comprising:

via an engine controller:

sealing a fuel system after an engine pull-down;

distinguishing degradation of a canister vent valve from degradation of a canister purge valve based on a change in fuel system vacuum following the sealing;

in response to canister vent valve degradation being distinguished from the change, limiting subsequent fuel vapor purging via the canister purge valve;

in response to canister purge valve degradation being distinguished from the change, closing the canister vent valve;

monitoring fuel tank pressure during engine running conditions and wherein the distinguishing includes, in response to fuel system vacuum being higher than a threshold before the sealing and being lower than the threshold after the sealing, indicating canister purge valve degradation and not indicating canister vent valve degradation, and in response thereto, closing the canister vent valve;

in response to fuel system vacuum being higher than the threshold before the sealing and after the sealing, actuating the canister purge valve closed while actuating the canister vent valve open, and indicating canister vent valve degradation but not canister purge valve degradation in response to the fuel system vacuum remaining higher than the threshold after the actuating and limiting subsequent fuel vapor purging in response to the indication of canister vent valve degradation; and indicating a blockage in a fresh air line in response to bleed-up of the fuel system vacuum from the threshold after the actuating, wherein sealing the fuel system includes closing the canister vent valve to seal the fuel system from atmosphere, and closing the canister purge valve to seal the fuel system from engine intake, the method further comprising indicating, via the controller, the distinguished degradation, wherein the controller receives the fuel system vacuum from a sensor coupled to a fuel tank of the fuel system, and wherein indicating canister vent valve degradation includes indicating that a canister vent valve solenoid is stuck closed.

2. The method of claim 1, wherein indicating canister purge valve degradation includes indicating that the canister purge valve is stuck open.

3. The method of claim 1, wherein the engine pull-down includes each of a vehicle key-off condition, a vehicle key-on engine idle-stop, and a vehicle key-on electric mode of operation.

4. The method of claim 3, further comprising maintaining the engine controller awake during the engine pull-down.

5. The method of claim 1, wherein the fuel system vacuum includes a fuel tank vacuum level.

6. A method for a vehicle fuel system, comprising:

via a controller:

sealing a fuel tank from atmosphere and engine intake after an engine pull-down;

during a first condition, indicating canister purge valve degradation based on a change in fuel tank vacuum following the sealing;

during a second condition, indicating canister vent valve degradation based on the change in fuel tank vacuum following the sealing;

adjusting vehicle fuel system operation based on the indications; and monitoring fuel tank pressure during engine running conditions, and wherein the sealing is performed in response to fuel tank vacuum being higher than a threshold during engine running, and further wherein the sealing is performed after the engine pull-down, the controller receiving fuel tank vacuum from a fuel tank pressure sensor coupled to the fuel tank.

7. The method of claim 6, wherein sealing the fuel tank from atmosphere and engine intake includes actuating a canister vent valve closed while maintaining a canister purge valve closed.

8. The method of claim 7, wherein, during the first condition, the indicating includes indicating that the canister purge valve is stuck open in response to the fuel tank vacuum being lower than the threshold following the sealing.

9. The method of claim 8, wherein, during the second condition, the indicating includes indicating that the canister vent valve is stuck closed in response to the fuel tank vacuum remaining higher than the threshold after the sealing, and also remaining higher than the threshold upon actuating the canister vent valve open, the method further comprising disabling purging in response to the canister vent valve indicated as stuck closed, and closing the canister vent valve in response to the canister purge valve indicated as stuck open.

10. The method of claim 9, further comprising, during a third condition, in response to fuel tank vacuum remaining higher than the threshold after the sealing, and bleeding up to atmospheric conditions upon actuating the canister vent valve, indicating no degradation of either the canister vent valve or the canister purge valve, and further indicating a blockage in a canister fresh air line, the method further comprising disabling purging operation in response to the indication of no degradation of either the canister vent valve or the canister purge valve and the indication of the blockage during the third condition.

11. A fuel system for a vehicle, comprising:

a fuel tank for storing fuel used by a vehicle engine;

a canister coupled to the fuel tank for receiving and storing fuel tank vapors;

a canister purge valve coupled between the canister and an engine intake manifold for delivering stored fuel tank vapors from the canister to the engine;

a canister vent valve coupled between the canister and atmosphere;

a sensor indicating fuel tank vacuum; and a controller with computer readable instructions for, receiving information indicative of fuel tank vacuum from the sensor;

in response to fuel tank vacuum being higher than a threshold during engine running, isolating the fuel tank after a subsequent engine pull-down;

monitoring a change in fuel tank vacuum following the engine pull-down; and distinguishing canister purge valve degradation from canister vent valve degradation based on the monitored change in fuel tank vacuum; and in response to canister vent valve degradation being distinguished, limiting subsequent fuel vapor purging via the canister purge valve; and in response to canister purge valve degradation being distinguished, closing the canister vent valve.

12. The system of claim 11, wherein the fuel tank being isolated after the engine pull-down includes the canister vent valve being actuated closed.

13. The system of claim 12, wherein the distinguishing includes indicating that the canister purge valve is stuck open in response to the fuel tank vacuum being lower than the threshold after the fuel tank is isolated, and indicating that the canister vent valve is stuck closed in response to the fuel tank vacuum remaining higher than the threshold after the fuel tank is isolated, and remaining higher than the threshold upon actuating the canister vent valve open.

14. The system of claim 13, wherein the controller includes further instructions for indicating a blockage in a fresh air line in response to bleed-up of the fuel tank vacuum from the threshold upon the actuating of the canister vent valve open.

15. The method of claim 6, wherein degradation of the canister vent valve is indicated based on whether excessive fuel tank vacuum persists in the sealed fuel tank after the engine pull-down, whereas degradation of the canister purge valve is indicated based on the fuel tank vacuum starting to bleed-up after the engine pull-down, the method further comprising disabling purging via the canister purge valve in response to the canister vent valve indicated as degraded, and closing the canister vent valve in response to the canister purge valve indicated as degraded.

* * * * *